US009580157B2

(12) United States Patent
Smith

(10) Patent No.: US 9,580,157 B2
(45) Date of Patent: Feb. 28, 2017

(54) SPORTS SUIT WITH HEATING SYSTEM AND KIT OF PARTS THEREFOR

(71) Applicant: Iain Richard Smith, Dunchurch (GB)

(72) Inventor: Iain Richard Smith, Dunchurch (GB)

( * ) Notice: Subject to any disclaimer, the term of this patent is extended or adjusted under 35 U.S.C. 154(b) by 142 days.

(21) Appl. No.: 14/370,266

(22) PCT Filed: Jan. 9, 2013

(86) PCT No.: PCT/EP2013/050260

§ 371 (c)(1),
(2) Date: Jul. 2, 2014

(87) PCT Pub. No.: WO2013/104645

PCT Pub. Date: Jul. 18, 2013

(65) Prior Publication Data

US 2015/0013040 A1 Jan. 15, 2015

(30) Foreign Application Priority Data

Jan. 9, 2012 (GB) ..... 1200254.9
Sep. 5, 2012 (GB) ..... 1215816.8

(51) Int. Cl.

| | |
|---|---|
| ***B63C 11/00*** | (2006.01) |
| ***B63C 11/28*** | (2006.01) |
| ***A41D 13/00*** | (2006.01) |
| ***A41D 13/005*** | (2006.01) |
| ***A41D 13/012*** | (2006.01) |
| ***B63C 11/04*** | (2006.01) |

(52) U.S. Cl.

CPC ..... *B63C 11/28* (2013.01); *A41D 13/0015* (2013.01); *A41D 13/0051* (2013.01); *A41D 13/012* (2013.01); *B63C 11/04* (2013.01); *B63C 2011/043* (2013.01); *B63C 2011/046* (2013.01)

(58) Field of Classification Search

CPC ..... B63C 11/28; B63C 11/00; B63C 11/04; B63C 11/046; B63C 11/043; B63C 2011/046; B63C 2011/043; A41D 13/0015; A41D 13/0051; A41D 13/012; A41D 13/005

USPC ..... 2/2.15, 67

See application file for complete search history.

(56) References Cited

U.S. PATENT DOCUMENTS 2,551,142 A * 5/1951 Lessard ..... 126/204
3,153,720 A 10/1964 Petronio et al.
(Continued)

FOREIGN PATENT DOCUMENTS

FR 409 261 A 4/1910

OTHER PUBLICATIONS

International Search Report, PCT/EP2013/050260 (2013).

*Primary Examiner* — Khaled Annis
(74) *Attorney, Agent, or Firm* — Walters & Wasylyna LLC

(57) ABSTRACT

A system that maintains a comfortable hand and/or feet temperature during the course of a water sports activity. Exhaled breath is fed to the inside of the sportsman's gloves and/or boots down a tube which runs along the inside of the wetsuit to take full advantage of the insulating properties of that wetsuit. Rubber moulding units at the rear neck wrists and/or ankles facilitate the tubing's entry and exit from the wetsuit without disturbing the watertight properties of that wetsuit. The rubber mouldings can either be built into the wetsuit itself or separate inserts to go between the sportsman's skin and the wetsuit seals at the neck wrists and ankles.

23 Claims, 10 Drawing Sheets

(56) References Cited

U.S. PATENT DOCUMENTS

| | | | | |
|---|---|---|---|---|
| 4,038,698 | A | 8/1977 | Smith | |
| 4,067,064 | A * | 1/1978 | Cerniway et al. | 2/2.15 |
| 4,683,869 | A * | 8/1987 | Wilcox | 126/204 |
| 5,029,572 | A * | 7/1991 | LeBlanc | 126/204 |
| 5,303,425 | A * | 4/1994 | Mele | 2/115 |
| 5,976,176 | A | 11/1999 | Webb | |
| 6,244,266 | B1 * | 6/2001 | Margiotta, Jr. | 128/201.13 |
| 6,415,453 | B1 * | 7/2002 | Anderson et al. | 2/458 |
| 6,807,964 | B1 * | 10/2004 | Ruddy | 128/204.17 |
| 7,958,888 | B2 * | 6/2011 | Wagner, III | 128/201.28 |
| 2004/0031090 | A1 * | 2/2004 | Duncan | 2/458 |
| 2006/0080756 | A1 * | 4/2006 | Goldfine | 2/102 |
| 2008/0268765 | A1 | 10/2008 | Luvera | |
| 2010/0199405 | A1 | 8/2010 | Nelson | |

* cited by examiner

SPORTS SUIT WITH HEATING SYSTEM AND KIT OF PARTS THEREFOR

This application is a U.S. national phase application of Intl. App. No. PCT/EP2013/050260 filed on Jan. 9, 2013, which claims priority from GB1200254.9 filed on Jan. 9, 2012, and from GB1215816.8 filed on Sep. 5, 2012.

TECHNICAL FIELD

The present invention relates to a sports suit for use in activities such as water sports, for example, wind surfing, paddling and the like. More particularly, but not exclusively, the invention relates to a sports suit and a kit of parts for modifying a sports suit, in which a system is provided for supplying warm breath exhaled by a sportsperson to a location proximate their hands and/or feet for warming their hands and/or feet.

BACKGROUND

The discomfort of cold hands and/or feet can be a limiting factor to the level of enjoyment derived from water sports, particularly in cold conditions. Using more substantial gloves or mittens and boots is often not compatible with carrying out the sporting activity. Chemical or electric heating pads do not have useful sustainability in cold water environments and may not be usable in wet environments.

In US 2008/0268765 a conduit for delivering warm air to a user's body with a multiplicity of warm air delivery holes arrayed along tubing is disclosed. A user wears a facemask over their nose and mouth to provide exhaled air into the tubing.

The present invention seeks to mitigate problems of the prior art by providing an improvement in the field of sports suits. In one aspect the invention provides a sports suit and in another aspect, the invention provides a kit of parts that can be retro fitted to an existing sports suit for modifying the sports suit. The sports suit and kit utilises the exhaled breath of the wearer of the sports suit.

Exhaled breath is a sustainable heat source that can ensure that a user's hands and/or feet are maintained at a comfortable temperature or are maintained at a temperature greater than they otherwise would be. More specifically, when the air temperature is as low as zero Celsius, with an associated wind chill below that, the sports suit and kit of the present invention can be used to mitigate against the cold conditions.

SUMMARY OF THE INVENTION

Upon reading the following description, it will be recognised that in general, the invention provides a sports suit, optionally a wetsuit, in which a heating system is either integrally formed or is retro-fitted thereto. The sports suit once fitted with a heating system from a kit of parts may be referred to herein as a "modified sports suit", whereas a sports suit having a heating system integrally formed therewith at manufacture may be referred to herein as an "integral sports suit". The heating systems of both the modified and integral sports suits, utilise or exploit the heat energy contained in the exhaled breath of a user of the sports suit to increase the temperature of a user's hands and/or feet.

Preferably, tubes feed warm exhaled breath to the hands and/or feet, optionally for circulation in the hand wear and/or footwear (for example gloves, mittens and boots) being worn by the sportsman. The actions associated with the water sport being carried out by the sportsman are not impeded in any way. To maximise the amount of heat energy transferred to the user's hands and/or feet, the tubes of the heating system are at least substantially disposed internally of the sports suit such that the normal insulating properties of the sports suit are used to insulate the tubes and exhaled breath of the heating system. In order to transfer the exhaled breath from a user's mouth, which is typically disposed externally of a sports suit, the heating system provides entry and/or exit points such that the tubes can run along the inside of the sport suit without destroying the structural integrity of the sports suit; without significantly affecting the insulating properties of the sport suit; and without breaking the water tight seals of the sport suit (which may preferably be a wetsuit).

Furthermore, to facilitate freedom of movement of the head whilst the user exhales into the heating system, the point of entry into the sports suit of the tubes is beneficially, albeit optionally located at the back of the neck of the sport suit.

A further option of the modified sport suit and/or integral sport suit is that the tubes can be removed and/or detached and the sports suit remains nevertheless water tight for use in more mild temperature conditions without the heating system.

Accordingly, in one aspect of the invention for which protection is sought, there is provided a sports suit comprising a heating system, the heating system comprising a mouth piece; tubing extending out of one or each side of the mouth piece and into the sports suit at one or more water tight entry points disposed proximate to a neck portion or opening of the sports suit; and one or more water tight exit points disposed proximate a wrist and/or ankle portion or opening of the sports suit, the tubing passing through said one or more water tight exit points and terminating proximate said wrist and/or ankle portion of the sports suit such that the heating system is configured to supply exhaled breath, input by a user of the sports suit at the mouth piece, to a user's hand and/or foot. Whereas typically the sports suit heating system will be used to heat both of a user's hands or feet, it is envisaged that there may be applications, for example where a user of the suit has a prosthetic limb, that only one hand or one foot may be heated by the heating system.

Preferably the sports suit is a wetsuit. The term "wetsuit" as used herein may be taken to mean a suit having a torso portion with full-length or short-length sleeves and full length or short length legs, optionally formed of a water tight or water proof material such as neoprene, foamed neoprene or like material for use in activities such as water sports, for example, wind surfing, canoeing, kayaking and diving, wherein water can enter the inside of the suit. Alternatively, the sports suit is a dry suit. The term "dry suit" as used herein may be taken to mean a suit having a torso portion with typically full-length sleeves and full length legs, optionally formed of a water tight or water proof material such as neoprene, foamed neoprene or the like for use in activities such as water sports, for example, wind surfing, canoeing, kayaking and diving, wherein water cannot enter or is at least restricted from entering the inside of the dry suit.

Optionally, the tubing extends out of each side of the mouth piece and into the sports suit at two water tight entry points disposed proximate to the neck portion of the sports suit.

Optionally, two water tight exit points are disposed proximate wrist portions of the sports suit such that the heating system is configured to supply exhaled breath, input by a user of the sports suit at the mouth piece, to the user's hands.

Alternatively, the sports suit comprises two water tight exit points disposed proximate ankle portions of the sports suit such that the heating system is configured to supply exhaled breath, input by a user of the sports suit at the mouth piece, to the user's feet.

Alternatively, the sports suit may comprise four water tight exit points disposed proximate wrist portions and ankle portions of the sports suit such that the heating system is configured to supply exhaled breath, input by a user of the sports suit at the mouth piece, to the user's hands and feet.

Optionally, the heating system comprises two splitters and wherein each splitter connects the tubing from one side of the mouthpiece to two separate tubes extending to an exit point at a wrist portion and an ankle portion of the sports suit respectively.

Optionally, the diameter of each of said two separate tubes is less than the diameter of the tubing that extends directly from the mouthpiece. Preferably, the cross-sectional area of the tubing from the mouthpiece is at least substantially the same as or greater than the sum of the cross-sectional areas of said two separate tubes.

Optionally, the heating system comprises two mouthpieces, wherein tubing extends out of each side of a first of the two mouthpieces and into the sports suit at two water tight entry points disposed proximate to a neck portion of the sports suit and wherein the tubing from the first mouthpiece extends to two water tight exit points disposed proximate wrist portions of the sports suit and wherein tubing extends out of each side of a second of the two mouthpieces and into the sports suit at two water tight entry points disposed proximate to a neck portion of the sports suit and wherein the tubing from the second mouthpiece extends to two water tight exit points disposed proximate ankle portions of the sports suit such that the heating system can be used to heat either the user's hands or the users feet.

Additionally, the length of the tubing extending between the first mouthpiece and the two water tight entry points disposed proximate to a neck portion of the sports suit may be shorter than the length of the tubing extending between the second mouthpiece and the two water tight entry points disposed proximate to a neck portion of the sports suit.

Alternatively, the length of the tubing extending between the first mouthpiece and the two water tight entry points disposed proximate to a neck portion of the sports suit may be longer than the length of the tubing extending between the second mouthpiece and the two water tight entry points disposed proximate to a neck portion of the sports suit.

Optionally, between about 80% and about 97% of the tubing of the sports suit is disposed internally of the sports suit such that the insulating properties of the sport suit insulate the exhaled air being supplied by the tubing.

Preferably, the sports suit is a wetsuit and the one or more entry points and one or more water tight exit points are defined by mouldings affixed at least substantially to the outside of the wetsuit and in a sealing manner such that the water tightness of the wetsuit is maintained.

Optionally, the mouldings are formed of rubber material and wherein an aperture formed within the moulding through which the tubing extends is equal to or smaller in diameter than the diameter of the tubing and due to the elasticity of the rubber moulding the tubing fits tightly within the moulding.

Preferably, the tubing is moveable though the aperture in the moulding such that the length of the tubing between entry and exit points is adjustable.

Optionally, the moulding comprises a tapered body having a bore therethrough and wherein one end of the bore is a circular aperture and wherein the other end of the bore is an elliptical aperture disposed within a base portion of the moulding that provides a perimeter about the body which is used to form a sealing bond with the wetsuit.

Optionally, the moulding is an insert moulding disposed at least substantially within an integral neck, wrist or ankle seal of the sports suit and comprises a body having one or more bores therethrough for the tubing and comprises a hook or projection for seating the insert moulding onto an edge of the neck, wrist or ankle seal of the wetsuit.

Additionally or alternatively, the tubes are removable from the sports suit. In this way the heating system can be disabled and the sports suit used without the tubing. This is beneficial in fairer weather.

Optionally, the sports suit may be provided with one or more stoppers for fitting into the one or more entry or exit points after removal of the tubing.

According to another aspect of the invention for which protection is sought, there is provided a kit of parts configured and arranged to form the sports suit being a wetsuit or a dry suit for use in water sporting comprising a heating system, wherein, the kit of parts comprises: a mouth piece, one or more lengths of tubing, one or more entry mouldings and/or one or more exit mouldings and/or one or more insert mouldings, wherein the mouth piece and one or more lengths of tubing are structured and configured such that upon assembly of the kit of parts tubing extends out of one or each side of the mouth piece; wherein the one or more entry mouldings or the one or more insert mouldings and the one or more lengths of tubing are structured and arranged such that upon assembly of the kit of parts, one or more water tight entry points are formed proximate to a neck portion at the back of the sports suit; and wherein the one or more exit mouldings are configured and arranged such that upon assembly of the kit of parts one or more water tight exit points are disposed proximate a wrist and/or ankle portion of the sports suit and tubing passes through said one or more water tight exit points and terminates proximate said wrist and/or ankle portion of the sports suit such that the heating system is configured to supply exhaled breath, input at the mouth piece, to a hand and/or foot of a user of the sports suit assembled using the kit of parts.

Additionally, the kit of parts may further comprise one or more stoppers for fitting into the one or more entry or exit mouldings.

Optionally, the entry and exit mouldings comprise a tapered body having a bore therethrough and wherein one end of the bore is a circular aperture and wherein the other end of the bore is an elliptical aperture disposed within a base portion of the moulding that provides a perimeter about the body which is used to form a sealing bond with the sports suit.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described solely by way of example, with reference to the accompanying drawings, in which.

DETAILED DESCRIPTION OF SPECIFIC EMBODIMENTS

Detailed descriptions of specific embodiments of the sports suit and kit of parts of the present invention are disclosed herein. It will be understood that the disclosed embodiments are merely examples of the way in which certain aspects of the invention can be implemented and do not represent an exhaustive list of all of the ways the invention may be embodied. Indeed, it will be understood that the sports suit and kit of parts described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
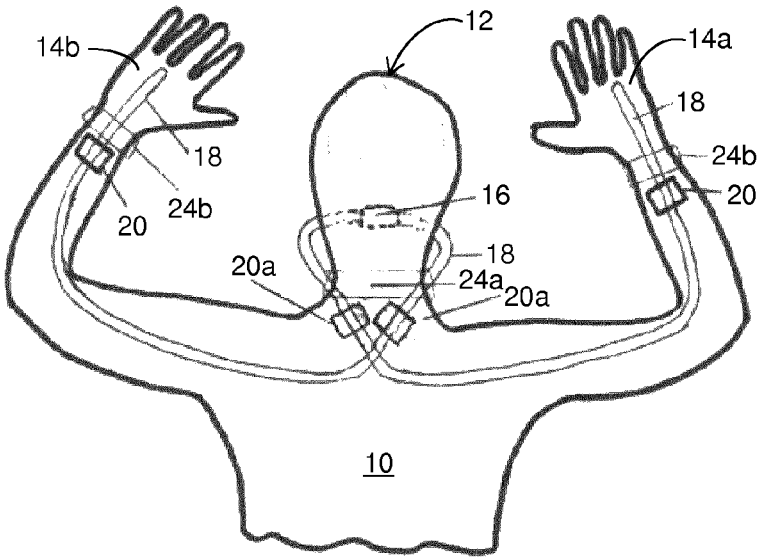
FIG. 1 is a schematic plan view from the back of part of a sports suit being worn by a sportsman according to an embodiment of the invention.

Referring now to FIG. 1, there is shown an illustration of an integral sports suit 10 according to a first embodiment of the invention having a heating system. FIG. 1 shows the back of a water sportsman 12. In an integral sports suit 10 according to the illustrated embodiment, aspects of the heating system are built into or formed as part of the construction of the sports suit 10. The illustrated sports suit is a wetsuit optionally formed of neoprene. Similar water tight or water proof material may be used to form the sports suit.

Optionally, in this illustrated arrangement, the heating system is configured to only deliver exhaled breath to the user's hands 14*a*, 14*b*. Typically a user may be wearing gloves or mittens (optionally also formed of neoprene or a similar water tight or water proof material) and the exhaled breath may circulate within the gloves or mittens. The sport suit 10 heating system comprises: a mouth piece 16 out of each side of which flexible tubing 18 extends. The flexible tubing 18 extends from the sportsman's 12 mouth to each hand 14*a*, 14*b*. Two entry points 20*a* defined by rubber mouldings 20*a* are built into or affixed onto the sports suit 10 to facilitate the watertight entry of the tubing 18 from the mouthpiece 16 into the sports suit. By water tight it is meant an entry point that does not allow the ingress or egress of water into or out of the sports suit (once tubing fitted therethrough). Preferably, the two entry points 20*a* are located proximate to the neck seal 24*a* of the sports suit, just below the neck seal 24*a* at the back of the neck. Two exit points 20 defined by rubber mouldings 20 are built into or affixed onto the sports suit 10 to facilitate the watertight exit of the tubing 18 from the inside the sports suit 10. The two exit points 20 are located proximate to wrist seals 24*b* of the sports suit 10. Optionally, the two exit points 20 are each located on the back of the sleeves of the sports suit 10, just above the wrist seals 24*b* of the sports suit.

Preferably, the two entry points 20*a* are symmetrically positioned so that the length of tubing 18 extending from each side of the mouthpiece 16 is at least substantially equal. Preferably the length of tubing between the mouthpiece 16 and the entry points 20*a* is greater than the linear distance therebetween so that the tubing 18 fits comfortably and not tightly alongside the user's cheeks and neck. Additionally, the mouthpiece 16 can be released from a user's mouth during a period when no heating of the hands is required and the tubing 18 either side of the mouthpiece 16 is sufficiently long that the mouthpiece 16 can come to rest on the user's chest. In this way the mouthpiece 16 and tubing 18 is moved out of the way of the sportsman 12 and yet remains in easy reach for re-inerstion into the user's mouth for further heating of the sportsman's hands 14*a*, 14*b*.

Figure 2:
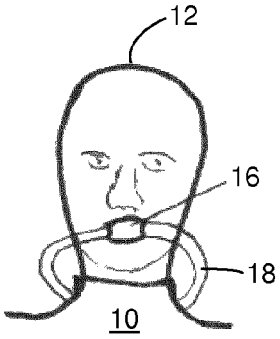
FIG. 2 is a schematic plan view from the front of part of a sports suit of FIG. 1 being worn by a sportsman.

In FIG. 2 the integral sports suit 10 and heating system is shown from the front, wherein the mouthpiece 16 is inserted into the user's mouth. The mouthpiece 16 is illustrated with the tubing 18 running from the mouth round the back of the neck for subsequent entry into the sports suit 10.

Figure 3:
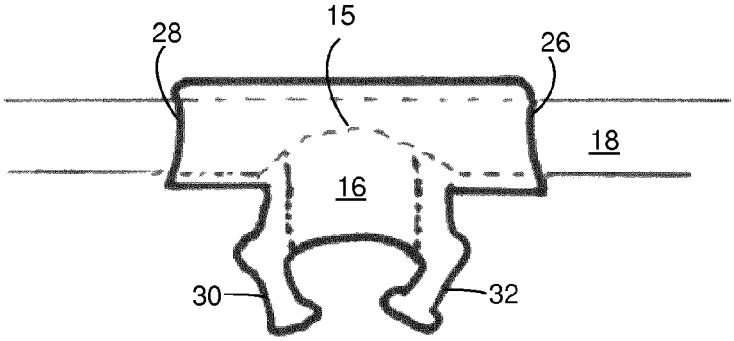
FIG. 3 is an enlarged view of a mouthpiece part that may be integrated into a sports suit according to FIGS. 1 and 2.

In FIG. 3 an enlarged view of the mouthpiece 16 is provided. Optionally the mouthpiece is a unitary, moulded rubber mouthpiece 16 having apertures 26, 28 on either side thereof into which the tubing 18 passes. The tubing 18 is shown in dotted outline where it is shown inside of the mouthpiece 16. It can be seen that optionally, the tubing 18 is continuous within the mouthpiece 16. In other envisaged embodiments, the mouthpiece 16 is configured such that an end of the tubing 18 is inserted into each side of the mouthpiece 16 and the tubing 18 is not continuous within the mouthpiece 16. In the presently illustrated arrangement, the continuous tubing 18 comprises an aperture 15 through which the exhaled breath of the sportsman 12 can enter into the tubing 18. Optionally, the mouthpiece 16 may comprise resilient arms 32, 30 which may serve to retain the mouthpiece 16 within the user's mouth. Optionally, the mouthpiece 16 is ergonomically shaped so that it fits comfortably within the user's mouth and is sized to allow the user to close their mouth comfortably around the mouthpiece 16 to ensure an efficient transfer of exhaled breath into the tubing 18.

Figure 4:
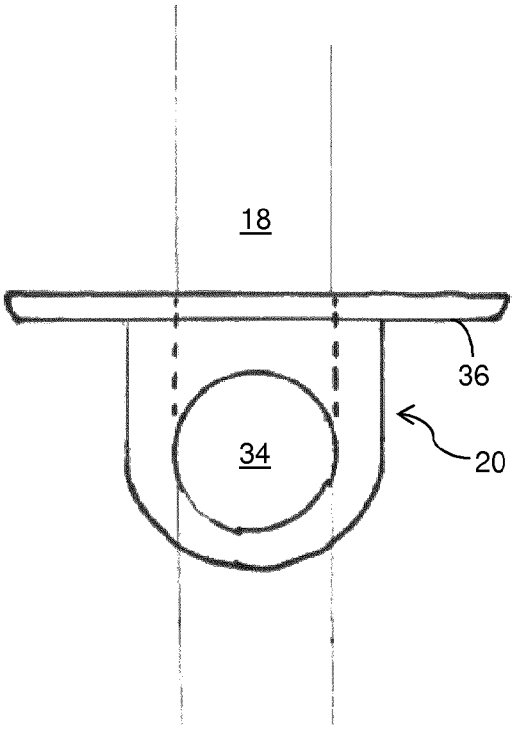
FIG. 4 is a plan view from a front end of an entry or exit component that is integrated into a sports suit according to FIGS. 1 and 2.
Figure 5:
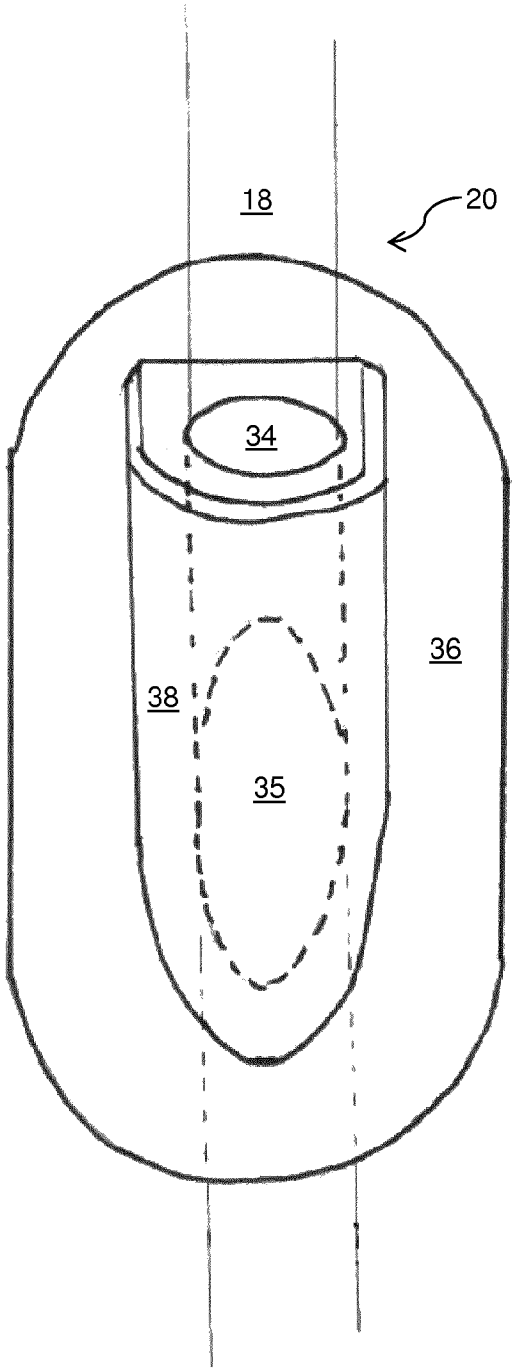
FIG. 5 is a top view of an entry or exit component that is integrated into a sports suit according to FIGS. 1 and 2.
Figure 6:
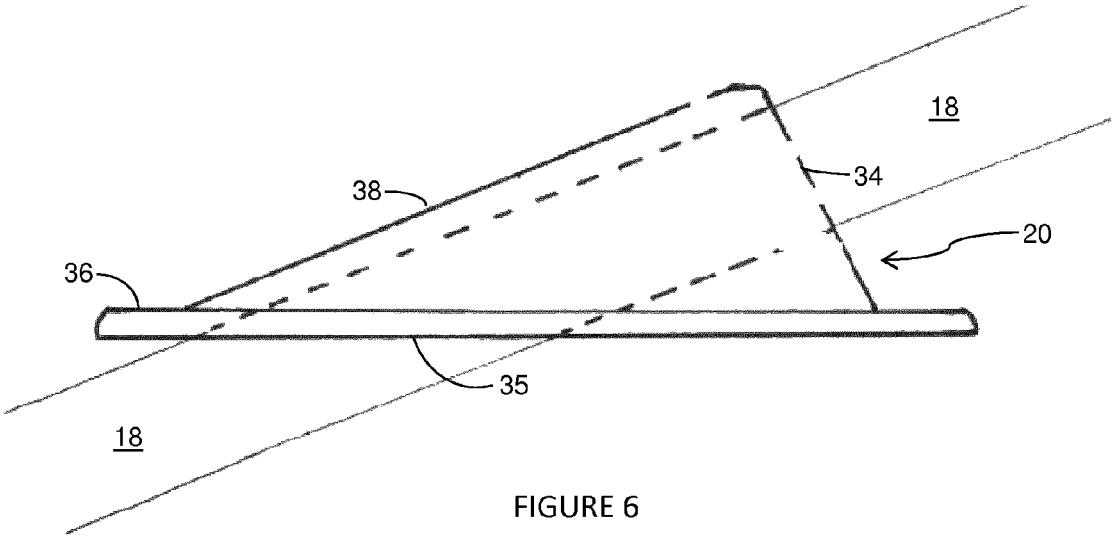
FIG. 6 is a plan view from the side of an entry or exit component that may be integrated into a sports suit according to FIGS. 1 and 2.

Optionally, the mouldings 20*a* for the entry points and the mouldings 20 for the exit points are of the same design. In FIGS. 4, 5 and 6 a moulding 20 is shown in plan, side and end elevation view. The moulding 20 comprises an aperture or bore running through the core 38 of the moulding 20. A first external aperture 34 is defined for receiving the tubing 18 from outside of the sports suit 10. A second internal aperture 35 is defined for passing the tubing 18 from within the bore of the moulding 20 internally of the sport suit 10. The body 38 of the moulding 20 is preferably angled or tapered, optionally between about 20° and about 25°. The moulding 20 comprises a base 36 which is flattish and sized such that when the moulding is bonded to the sport suit 10 a seal is formed between the external surface of the sports suit 10 and the moulding 20, 20*a*. As such the rubber moulding 20, 20*a*, when mounted onto and/or partially within the sports suit 10 provides for the water tight entry and exit of tubing 18 from the sport suit 10 at various locations over the body of the sports suit 10.

In the present embodiment, the moulding 20*a* is used as an entry point 20*a* at the back of the neck. In this arrangement, the moulding 20*a* is mounted such that the opening 34 is directed towards the incoming tubing 18. The tubing 18 follows a curved path from the mouthpiece 16 to the back of the neck and therefore the mouldings 20*a* may each be angled (see FIG. 1) so that they are in line within the incoming tubing 18 and thereby facilitate entry of the tubing 18 without tension (or with a minimum of tension in the tubing 18). The channel or bore that extends though the moulding 20 and has open ends 34, 35 may have a diameter that is equal to or less than the diameter of the tubing 18. In this way the tubing 18 fits, with a tight friction fit, within the bore of the body 38. The elasticity of the rubber moulding 20 may facilitate the tight-fit of the tubing 18 within the moulding 20. Preferably the tightness of the elastic fit and the size of the restricted aperture is not so restricted that the tubing 18 would be crushed or squashed. Furthermore the tubing 18 is sufficiently thick and/or rigid that it can withstand the elastic tension of the rubber moulding 20, 20*a* without being crushed.

It will be recognised that the tapered nature of the moulding body 38 advantageously provides a guided entry or exit point for the tubing 18 and as such, the cross-sectional shape of the bore or channel therein is not circular throughout. Preferably, the external end aperture 34 has a shape that is similar to or matches the cross-sectional shape of the tubing (based on a normal axial cross-section), in this case circular. Preferably, the internal end aperture 35 has a shape that is similar to or matches an oblique cross-section of the tubing 18, in this case elliptical or oval.

In the present embodiment, the moulding 20 is used as an exit point mounted to the back-side of the sleeves of the sports suit proximate wrist seals 24*b* of the sports suit. Acting as an exit point, the moulding 20 is mounted such that the opening 34 is closest to the wrist seal 24*b*. The tubing 18 is gradually guided (by the tapered body 38) from inside the sports suit 10. This allows the tubing to follow a path internally of the suit that is close to, if not in contact with the sports suit 10. Optionally, the mounting for the exit point may be angled to optimise the position of the tubing 18 as it exits the sport suit 10 and optionally enters into the user's gloves.

Because the tubing 18 frictionally slides within the holes provided in the mouldings 20, 20*a*. The actual length of tubing 18 at various points though the heating system is to some extent at least, adjustable.

The water tight property is derived from moulding 20, 20*a* forming a tight partially elastic fit around tubing 18. This feature also gives the user of the sports suit 10 the option to remove the tubing 18 from the sport suit 10 entirely. In such a situation an optional insert rubber stopper 22 is provided to plug into the vacant holes of moulding 20, 20*a*.

Figure 7:
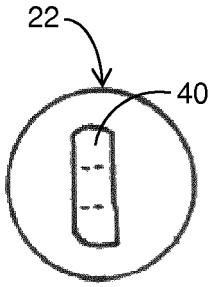
FIG. 7 is a plan top view of a stopper that optionally can be inserted into the entry or exit component of FIGS. 4-6.
Figure 8:
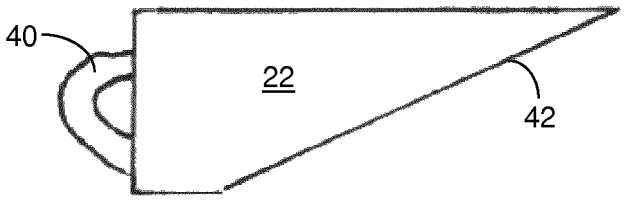
FIG. 8 is a plan side view of a stopper that optionally can be inserted into the entry or exit component of FIGS. 4-6.
Figure 9:
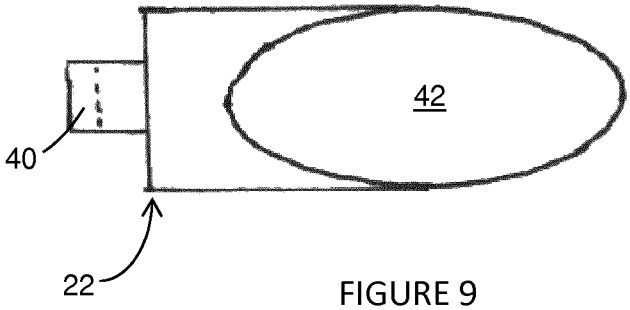
FIG. 9 is an end elevation of a stopper that optionally can be inserted into the entry or exit component of FIGS. 4-6.

FIGS. 7, 8 and 9 show a plan, side and end elevation view of a rubber stopper 22 that can be inserted into moulding unit 20, 20*a* to seal up the hole therein if tubing 18 is removed from the heating system. This gives the user the option to use the sport suit that has had mouldings 20, 20*a* integrated into it without the hand (and/or foot) heating system installed. It is envisaged that where an integral sport suit is provided (rather than a kit of parts for forming a modified sports suit) that one or more rubber stoppers 22 may be supplied with the sport suit 10 as an ancillary component.

The stopper 22 optionally comprises a body tapered similarly to the tapered bore 38 and sized to tightly fit therewithin. A handle 40 may be integrally moulded with the body of the stopper 22 so that a user can grasp the stopper 22 for easy insertion and extraction. Optionally a base 42 of the stopper 22 is sized and shaped similarly to the internal end 35 of the moulding 20, 20*a* so that once installed, the stopper 22 fits at least substantially flush with the moulding 20, 20*a*.

A substantial part of the tubing 18 is disposed internally of the sports suit 10 such that the exhaled breath may be insulated by the material of the sports suit 10. Optionally between about 85% and 97% of the tubing 18 is disposed internally of the sports suit 10. It is envisaged that the externally disposed tubing 18 and/or the internally disposed tubing 18 may be formed from a thermally insulating material or may be coated in a thermally insulating material. The tubing 18 is preferably water proof i.e. impermeable to water such that only air and/or breath flows within the tubing 18 and water is not permitted to enter the tubing 18.

An optional aspect of the invention allows for the removal of the tubing 18, however in other envisaged embodiments, the tubing may be connected to the inside of the sports suit 10, optionally by using one or more or a series of material loops so that the tubing 18 is guided through a specific route within the sports suit 10.

Referring now to FIGS. 10 to 17; 18 to 20 and 21 to 22, there are shown alternative embodiments of the present invention. In the second, third and fourth illustrated embodiments, like numerals have, where possible, been used to denote like parts, albeit with the addition of the prefix "100" or "200" or "300" to indicate that these features belong to the second, third and fourth embodiments respectively. The alternative embodiments share many common features with the first embodiment and therefore only the differences from the embodiment illustrated in FIGS. 1 to 9 will be described in any greater detail.

Figure 10:
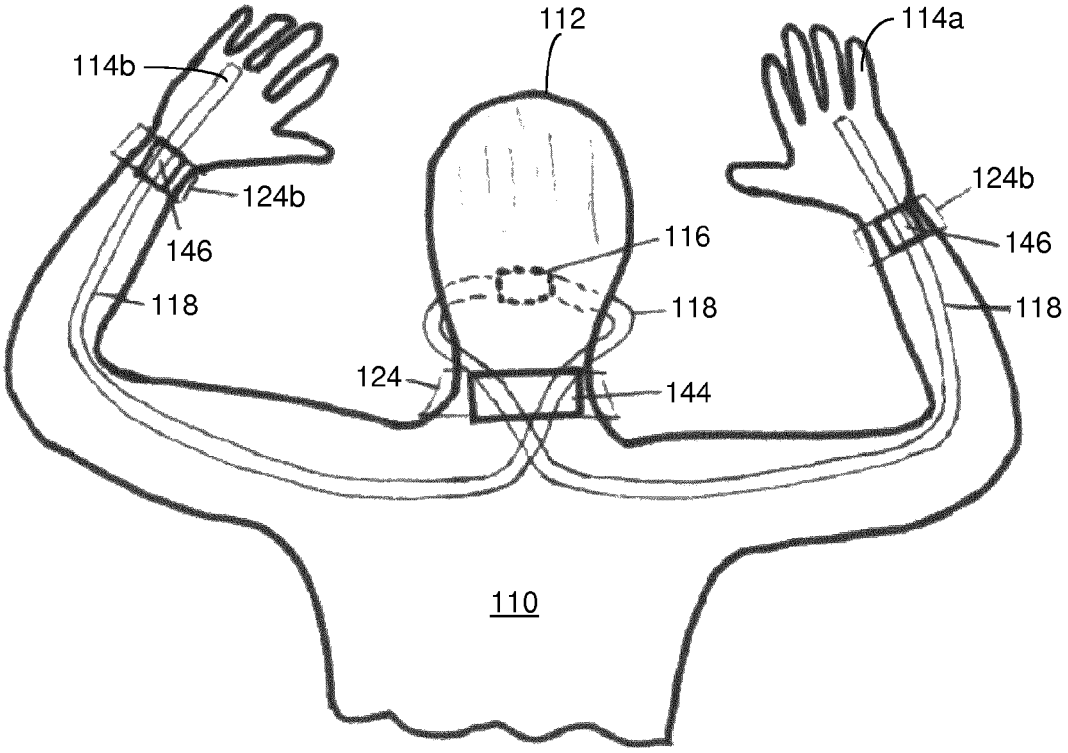
FIG. 10 is a schematic plan view from the back of part of a sports suit according to another embodiment of the invention, being worn by a sportsman.
Figure 11:
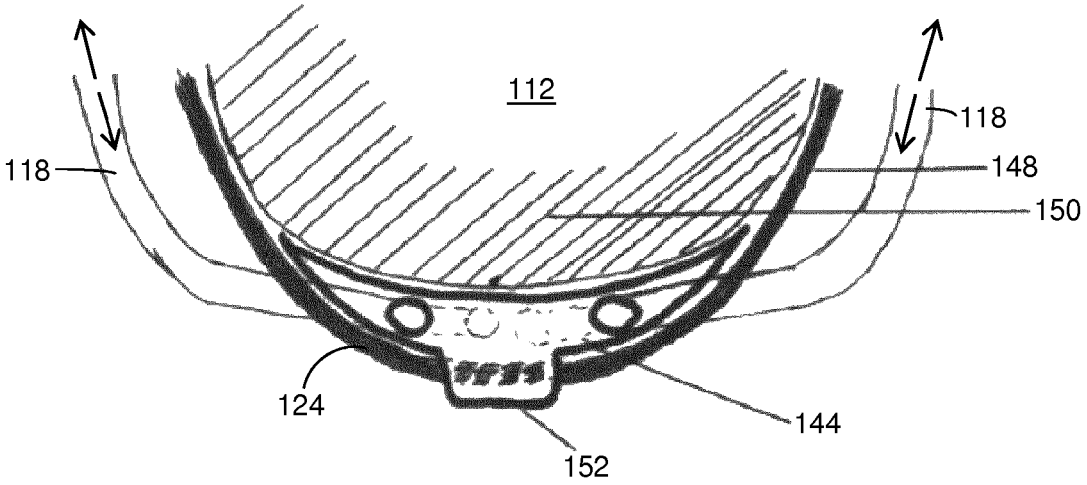
FIG. 11 is an enlarged cross-sectional view of the heating system of FIG. 10 at the point of entry into the sports suit down the rear neck seal of the sports suit.

In FIG. 10 a schematic illustration of a "modified" sport suit 110 (that is optionally a wetsuit having neck, wrist and ankle seals 124, 124*b*) is shown looking at the back of a water sportsman 112. In this embodiment, the heating system is not built into or integrated into the sport suit 110 at the time of manufacture of the suit 110 as such, but rather, the heating system comprises tubing 118, a mouthpiece 116 and moulding inserts 144, 146 that are configured to enter the sport suit 110 via the existing wetsuit neck 124, wrist 124*b* and/or ankle seals (not shown) that are retro fitted to a typical sport suit, for example a standard wet suit. The illustration of FIG. 3 shows only the hand heating part of the heating system In FIG. 11 a cross section illustration of the moulding insert 144 is shown at the point of entry into the wetsuit 110 down the rear neck seal 124 of the wetsuit. The rear side of the user's 112 neck is shown (shaded). Flexible tubing 118 extends from the sportsman's mouth to each hand via the rubber moulding 144 disposed at the neck (to facilitate the watertight entry of the tubing 118 into the wetsuit 110), down the inside of the neck seal 124 of the wetsuit at the back of the neck and though additional mouldings 146 disposed within the wrist seals 124*b* and out of the wrist seals 124*b*. The rubber moulding 144 disposed on the inside of the neoprene neck seal running around the water sportsman's neck is shown in FIG. 11. Optionally, the rubber moulding 144 comprises a hook 152 or projection 152, integrally formed as part of the moulding 144, that rests on the top edge 148 of the neoprene neck seal 124 to ensure the two are lined up whist being worn.

Figure 12:
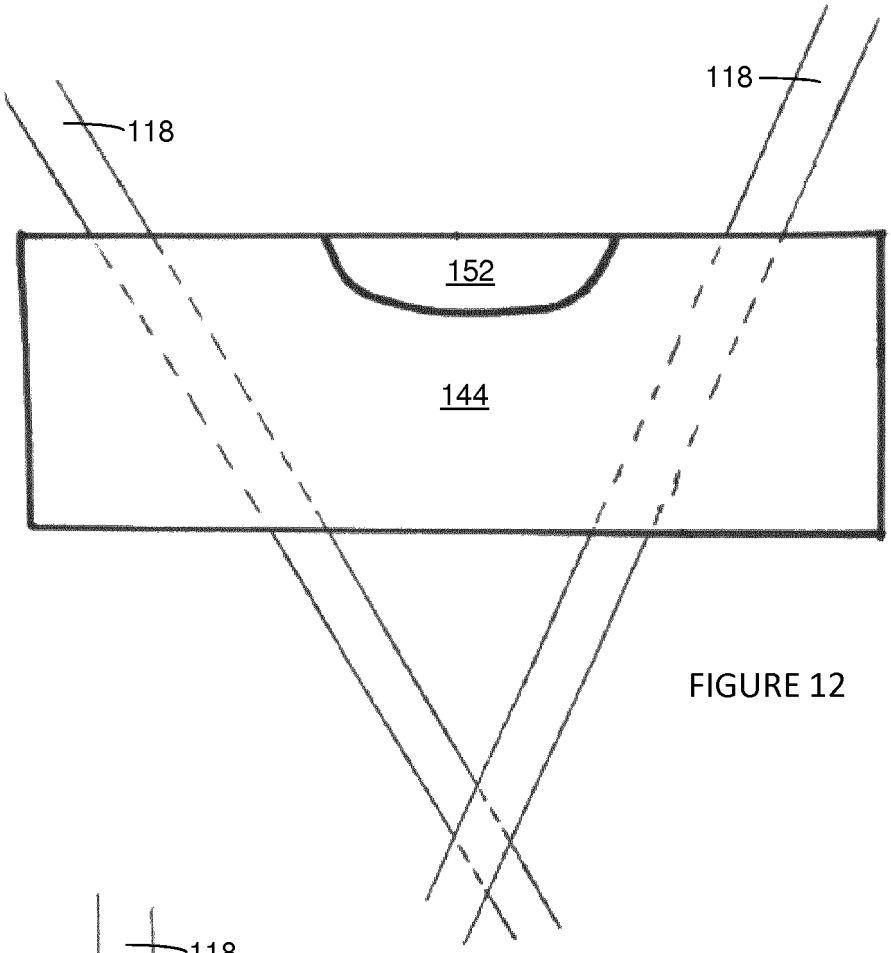
FIG. 12 is a plan view of an entry point moulding of the heating system of FIG. 10 which facilitates water tight entry of tubing into the sports suit proximate a rear neck seal of the sports suit.
Figure 13:
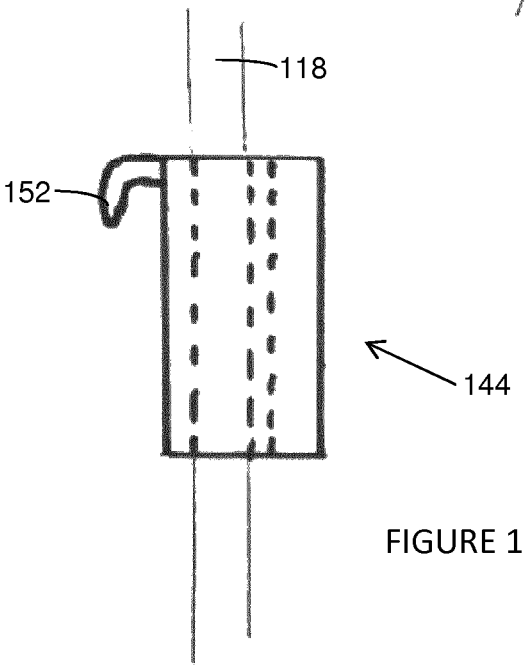
FIG. 13 is an end view of an entry point moulding of the heating system of FIG. 10 which facilitates water tight entry of tubing into the sports suit proximate a rear neck seal of the sports suit.
Figure 14:
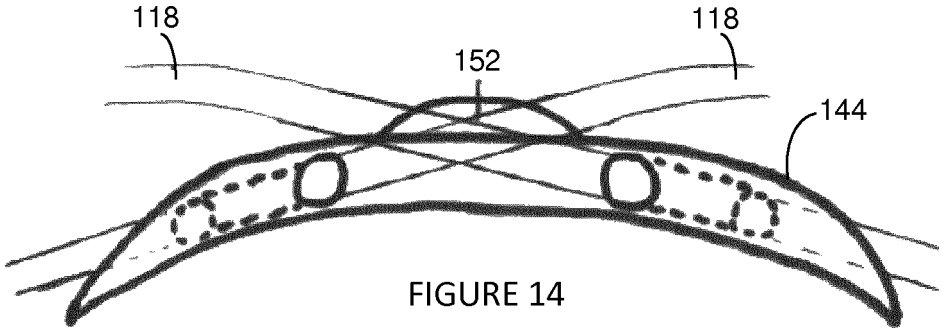
FIG. 14 is a bottom view of an entry point moulding of the heating system of FIG. 10 which facilitates water tight entry of tubing into the sports suit proximate a rear neck seal of the sports suit.

FIGS. 12, 13 and 14 show plan, end and bottom views of the moulding 144 which facilitates the water tight entry of the tubing 118 into the wetsuit 110 down the rear wetsuit neck seal 124. Tubing 118 and alignment hook 152 as previously described are indicated thereon.

Figure 15:
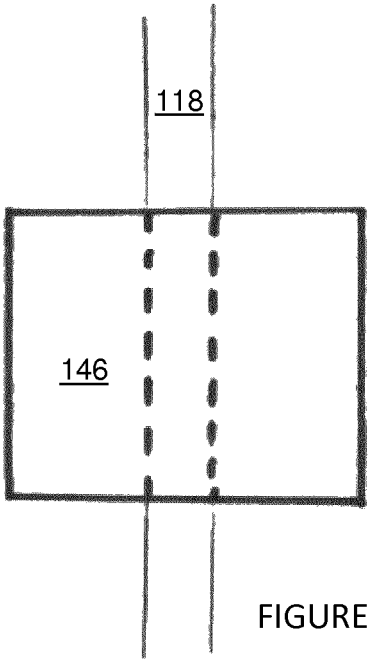
FIG. 15 is a plan view of an exit point moulding of the heating system kit of FIG. 10, which facilitates the water tight exit of tubing from the sports suit through the underside of the sports suit wrist and/or ankle seals.
Figure 16:
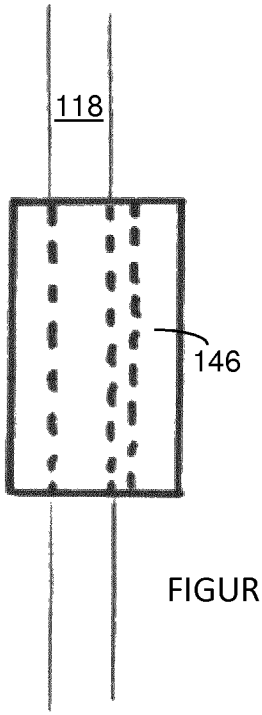
FIG. 16 is an end view of an exit point moulding of the heating system kit of FIG. 10, which facilitates the water tight exit of tubing from the sports suit through the underside of the sports suit wrist and/or ankle seals.
Figure 17:
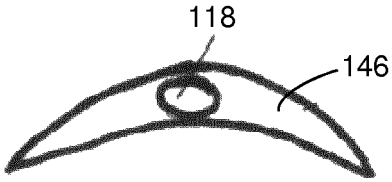
FIG. 17 is a bottom view of an exit point moulding of the heating system kit of FIG. 10, which facilitates the water tight exit of tubing from the sports suit through the underside of the sports suit wrist and/or ankle seals.

FIGS. 15, 16 and 17 show plan, end and bottom views of moulding 146 which facilitates the water tight exit of the tubing 118 from the wetsuit 110 through the underside of the wetsuit 110 wrist 124*b* and/or ankle seals (not shown). Tubing 118 as previously described is indicated thereon.

Optionally, wrist or ankle mouldings 146 may be used in a modified and/or integral sports suit to provide a draft proof entry of tubing 118 into a user's hand wear and/or footwear (for example glove, mitten or boot). In such an arrangement, the moulding 146 may be used in conjunction with the surface mounted exit point mouldings 20*a* described in respect of the first embodiment of FIG. 1. As such, when tubing 18, 118 has exited the users wetsuit via surface mounted exit point moulding 20*a* and then enters the user's hand-wear and/or footwear the moulding 146 can be provided as a hand-wear and/or footwear entry point. This may provide a further degree of stability into the heating system by providing a further guide for the tubing 18, 118 and advantageously may minimise or completely reduce any draft into the user's hand-wear and/or footwear.

Referring back to the second illustrated embodiment of FIGS. 10-16, by passing or threading the tubing 118 through suitably shaped mouldings 144, 146 at the neck wrist and/or ankles, with the moulding 144, 146 resting between the sportsman's skin and the wetsuit (optionally neoprene) seals 124, 124*b*, the watertight properties of the wetsuit are reorganised but not disturbed. Optionally, the mouldings 144, 146 are bonded to the neck, wrist and/or ankle seals 124, 124*b*

Tubing 118 simply slides inside the holes provided by the mouthpiece 116 and the mouldings 144 and 146. The actual length of tubing 118 at various points along the heating system is therefore adjustable. The water tight property and security of the tubing is derived from mouldings 144 and 146 forming a tight partially elastic fit around tubing 118.

Figure 18:
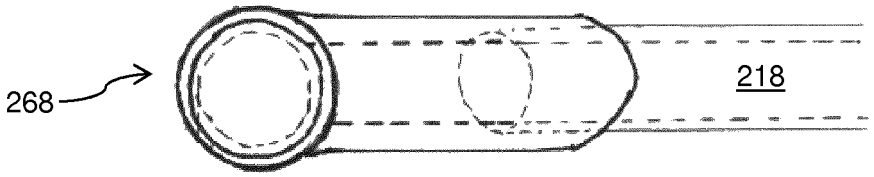
FIG. 18 is plan view of a splitter moulding of a heating system kit shown in FIG. 20.
Figure 19:
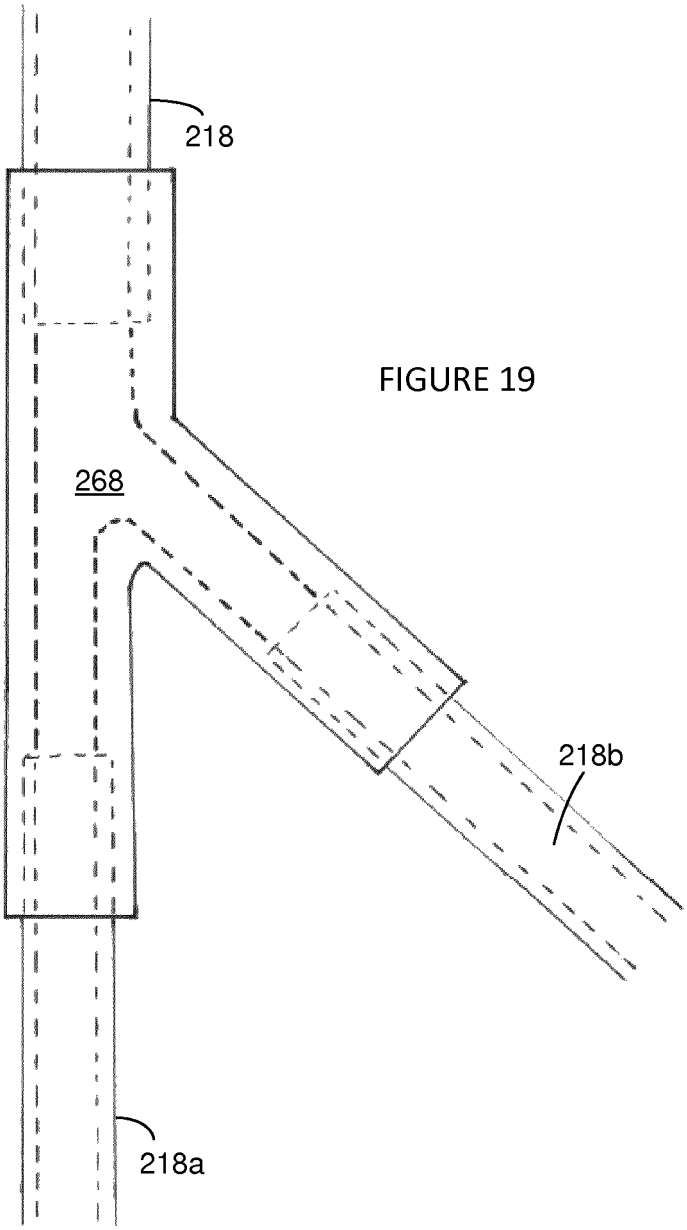
FIG. 19 is an end view of the splitter moulding of FIG. 18 comprised in the heating system kit shown in FIG. 20.
Figure 20:
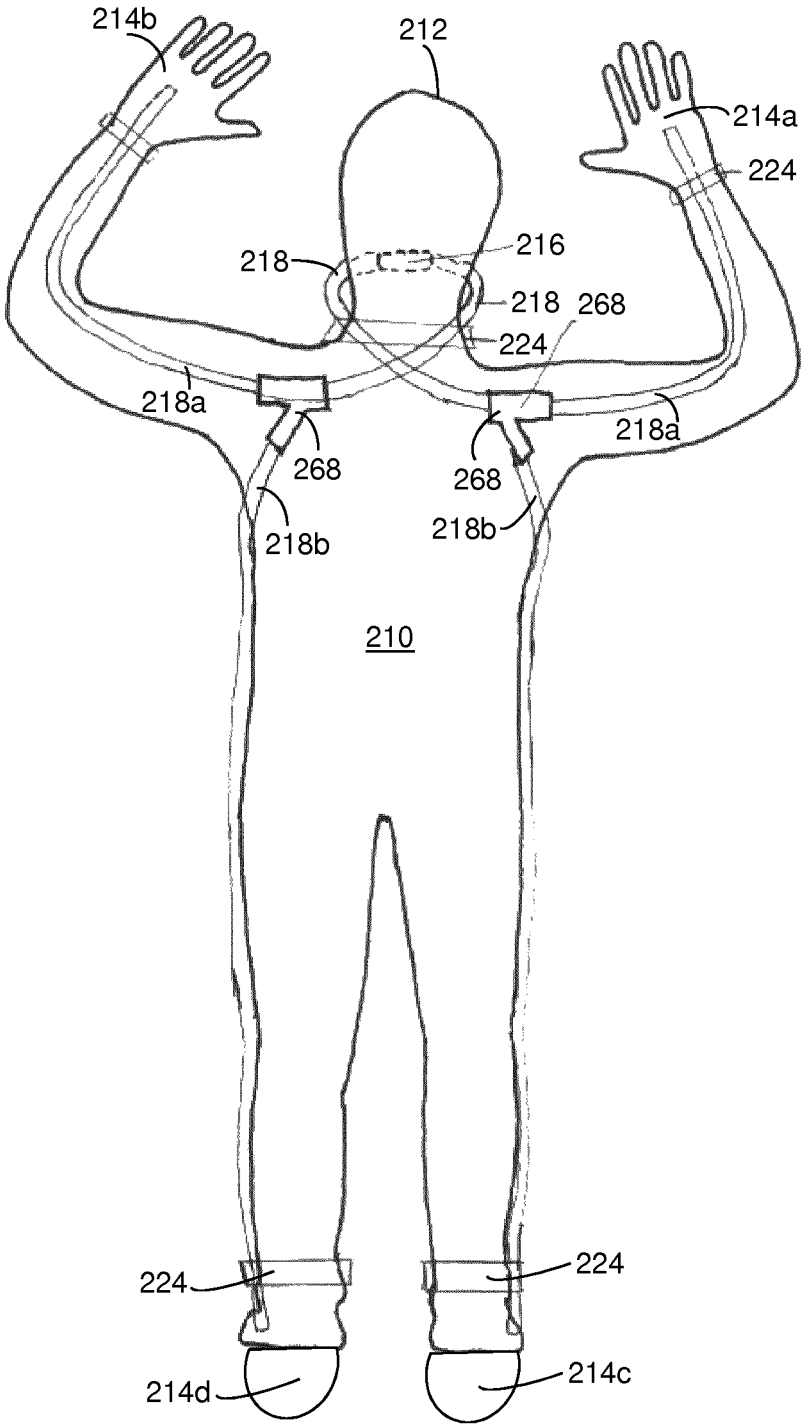
FIG. 20 is a schematic plan view from the back of a sports suit according to yet another embodiment of the invention, being worn by a sportsman.

FIGS. 18, and 19 show plan and end views of a splitter moulding 268 which provides for each of the two feeder tubes 218 entering the sports suit 210 at the back of the neck, optionally via a surface entry point moulding 224, to each then extend into two further tubes 218*a*, 218*b*. One of the further tubes 218*a* runs to a hand and the other further tube 218*b* runs to the foot on the same side of the sports suit 210. In FIG. 20, the use of two splitter mouldings 268 in a modified or integral sports suit 210 is illustrated wherein one of the splitter mouldings 268 enables tubes 218*a*, 218*b* to pass to the left-side hand and ankle to heat the sportsman's hand 214*b* and foot 214*d* and the other splitter moulding 268 enables tubes 218*a*, 218*b* to pass to the right-side hand and ankle to heat the sportsman's hand 214*a* and foot 214*c*. In an alternative embodiment, the splitter moulding can be used in conjunction with a neck seal moulding 144 as described above (but not illustrated) and/or a wrist or ankle seal moulding 146 as described above (but not illustrated). Where a moulding 146 is used it may be squeezed over tube 218*a*, 218*b* to sit between wetsuit seals 224 and the users skin at each wrist and ankle.

The internal area of the hole in the splitter moulding 268 optionally equates to the combined internal area of the two exiting tube holes. In other words, the further tubes 218*a*, 218*b* are preferably of narrower diameter than the incoming tubing 218.

The elastic properties of the splitter moulding 268 and the resultant friction based fit holds the tubing 218, 218*a*, 218*b* configuration together but also facilitates its easy dismantling for cleaning, reconfiguring and/or removal.

The distribution of exhaled breath to the hands and feet can be partially controlled by putting and adjusting straps (not shown) around the outside of the gloves and boots at the wrist and ankle where the majority of the exhaled breath escapes from the heating system.

Whilst inside and insulated by the sport suit 210 those two feeder tubes 218 are then each divided into two smaller tubes 218*a*, 218*b* using moulding unit 268 which in turn deliver breath to both the hands 214*a*, 214*b* and feet 214*c*, 214*d*.

Figure 21:
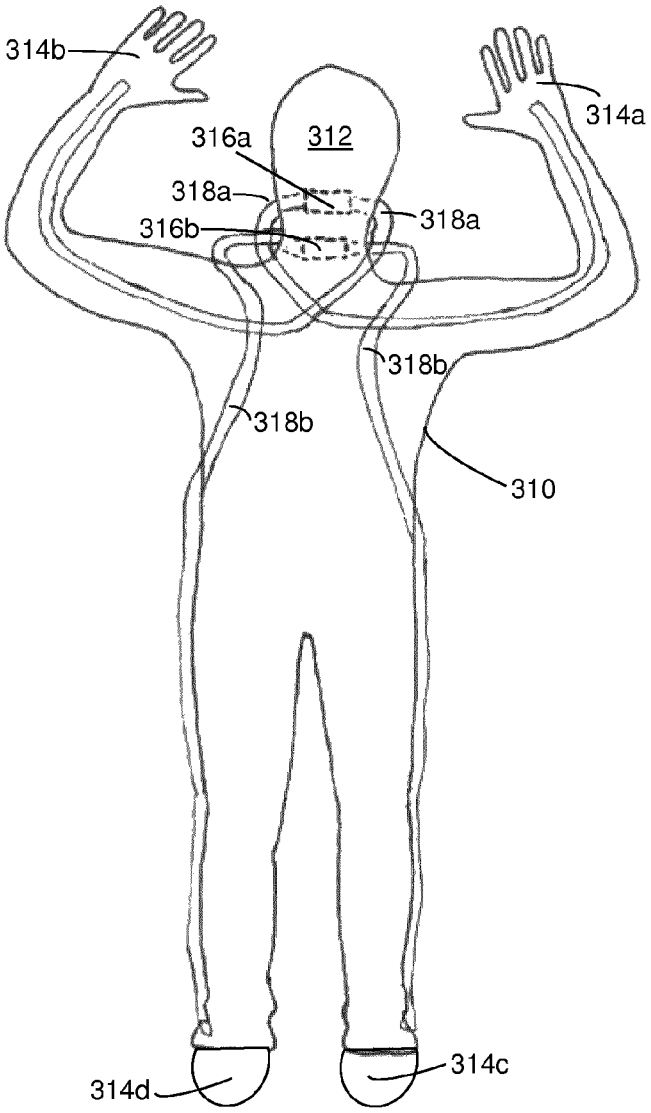
FIG. 21 is a schematic plan view from the back of a sports suit according to yet a further embodiment of the invention, being worn by a sportsman.
Figure 22:
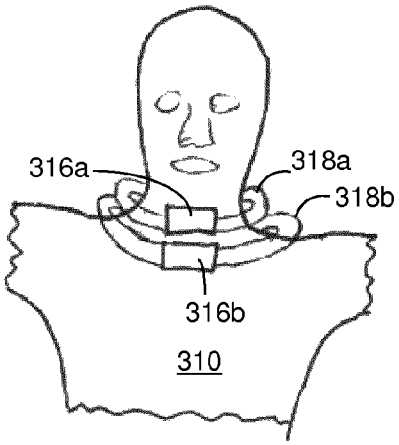
FIG. 22 is a schematic plan view from the front of part of the sports suit of FIG. 21.

In FIGS. 21 and 22 yet a further embodiment of integrated and modified sports suit 310 is shown. In FIG. 21 a full rear view of the system is provided whereas in FIG. 22 a partial front body view schematic of the heating system is shown. In this embodiment separate mouthpieces 316*a*, 316*b* are provided such that either the hands or the feet can be heated. In this illustrated configuration exhaled breath is used to deliver heat to both hands 314*a*, 314*b* via a first mouthpiece 316*a* and tubing 318*a* and to both feet 314*c*, 314*d* via a second mouthpiece 316*b* and tubing 318*b*.

Mouth piece 316*a* supplies exhaled breath along two tubes 318*a* entering the users sports suit 310 at the back of the neck. In this arrangement, the distribution of breath to the hands 314*a*, 314*b* and feet 314*c*, 314*d* is totally under the users control.

It will be recognised that either all four tubes 318*a*, 318*b* entry into the sports suit 310 at the back of the neck can be via surface style entry point mouldings 20, (as described above in respect of the first embodiment) or via, for example, four moulding inserts 144 (as described above in respect of the second embodiment) or by any suitable combination of the two types of moulding, for example two tubes 318*a* can enter via surface style entry point mouldings 20, and two tubes 318*b* can enter via moulding inserts 144 disposed within the neck seal of the sports suit 310. Similarly the tubes 318*a*, 318*b* exit from the sport suit 310 at the wrist and ankles and can be via any combination of surface style exit point mouldings 20*a* and moulding inserts 146.

As can be seen in FIG. 22, where a front facial view of the sports suit 310 of the fourth embodiment is shown, both mouthpieces 316*a*, 316*b* can come to rest on a user's chest beneath his chin and swivel up to his mouth. Preferably, the length of the tubing 318*b* for one mouthpiece 316*b* is slightly larger than the length of the tubing 318*a* extending from the other mouthpiece 316*a* thereby permitting either mouthpiece 316*a*, 316*b* to swivel up to the users mouth leaving the other one resting beneath the chin.

It can be appreciated that various changes may be made within the scope of the present invention, for example, in other embodiments of the invention it is envisaged that the rubber mouldings may be formed of another suitable mouldable elastic material, such as plastic. The length and diameter of the tubes may take many and various forms dependent upon the size and shape of the suit.

The present invention has been illustrated in relation to particular embodiments which are intended in all respects to be illustrative rather than restrictive. Those skilled in the art will recognize that the present invention is capable of many modifications and variations without departing from the scope of the invention. For example, as used herein, directional references such as "top", "base", "bottom", "end", "side", "upper", "middle", "lower", "front" and "rear" do not limit the respective aspects of the sports suit to such orientation, but merely serve to distinguish these aspects or features from one another.

The invention claimed is:

1. A sports suit, being a wetsuit or a dry suit for use in water sporting, comprising:

an interior facing a wearer and an exterior facing away from the wearer when worn;

a heating system, the heating system comprising a mouth piece; tubing extending out of one or each side of the mouth piece located on the exterior of the sports suit and into the interior of the sports suit at one or more water tight entry points disposed proximate to a neck opening at a back of the sports suit; and one or more water tight exit points disposed proximate to at least one of a wrist opening and an ankle opening of the sports suit, the tubing passing through said one or more water tight exit points from the interior to the exterior of the sports suit and terminating proximate the at least one of the wrist opening and the ankle opening of the sports suit such that the heating system is designed to supply exhaled breath, input by a user of the sports suit at the mouth piece, to at least one of a hand and a foot of a user through the tubing.

2. The sports suit according to claim 1 wherein the tubing extends out of each side of the mouth piece and into the sports suit at two water tight entry points disposed proximate to the neck opening at the back of the sports suit.

3. The sports suit according to claim 2 comprising two water tight exit points disposed proximate wrist openings of the sports suit such that the heating system is configured to supply exhaled breath, input by a user of the sports suit at the mouth piece, to the user's hands.

4. The sports suit according to claim 2 comprising two water tight exit points disposed proximate ankle openings of the sports suit such that the heating system is configured to supply exhaled breath, input by a user of the sports suit at the mouth piece, to the user's feet.

5. The sports suit according to claim 1 comprising four water tight exit points disposed proximate wrist openings and ankle openings of the sports suit such that the heating system is configured to supply exhaled breath, input by a user of the sports suit at the mouth piece, to the user's hands and feet.

6. The sports suit according to claim 5 wherein the heating system comprises two splitters and wherein each splitter connects the tubing from one side of the mouthpiece to two separate tubes extending to an exit point at a wrist opening and an ankle opening of the sports suit respectively.

7. The sports suit according to claim 6 wherein the diameter of each of said two separate tubes is less than the diameter of the tubing that extends from the mouthpiece.

8. The sports suit according to claim 7 wherein the cross-sectional area of the tubing from the mouthpiece is at least substantially the same as or greater than the sum of the cross-sectional areas of said two separate tubes.

9. The sports suit according to claim 1 wherein the heating system comprises two mouthpieces, wherein tubing extends out of each side of a first of the two mouthpieces and into the sports suit at two water tight entry points disposed proximate to a neck opening of the sports suit and wherein the tubing from the first mouthpiece extends to two water tight exit points disposed proximate wrist openings of the sports suit and wherein tubing extends out of each side of a second of the two mouthpieces and into the sports suit at two water tight entry points disposed proximate to a neck opening of the sports suit and wherein the tubing from the second mouthpiece extends to two water tight exit points disposed proximate ankle openings of the sports suit such that the heating system can be used to heat either the user's hands or the user's feet.

10. The sports suit according to claim 9 wherein the length of the tubing extending between the first mouthpiece and the two water tight entry points disposed proximate to a neck opening of the sports suit is shorter than the length of the tubing extending between the second mouthpiece and the two water tight entry points disposed proximate to a neck opening of the sports suit.

11. The sports suit according to claim 9 wherein the length of the tubing extending between the first mouthpiece and the two water tight entry points disposed proximate to a neck opening of the sports suit is longer than the length of the tubing extending between the second mouthpiece and the two water tight entry points disposed proximate to a neck opening of the sports suit.

12. The sports suit according to claim 1 wherein between about 80% and about 97% of the tubing of the heating system is disposed internally of the sports suit such that the insulating properties of the sport suit insulate the exhaled air being supplied by the tubing.

13. The sports suit according to claim 1 wherein the sports suit is a wetsuit and wherein the one or more entry points and one or more exit points are defined by mouldings affixed at least substantially to the outside of the sports suit and in a sealing manner such that water tightness of the sports suit is maintained.

14. The sports suit according to claim 13 wherein said mouldings are formed of rubber material and wherein an aperture formed within each of said mouldings through which the tubing extends is equal to or smaller in diameter than the diameter of the tubing and due to the elasticity of the rubber moulding the tubing fits tightly within each of said mouldings.

15. The sports suit according to claim 14 wherein the tubing is moveable though the aperture in each of said mouldings such that the length of the tubing between entry and exit points is adjustable.

16. The sports suit according to claim 13 wherein each of said mouldings comprises a tapered body having a bore therethrough and wherein one end of the bore is a circular aperture and wherein the other end of the bore is an elliptical aperture disposed within a base portion of each moulding that provides a perimeter about the body which is used to form a sealing bond with the wetsuit.

17. The sports suit according to claim 13 wherein each of said mouldings is an insert moulding disposed at least substantially within an integral neck, wrist or ankle seal of the sports suit and comprises a body having one or more bores therethrough for the tubing and comprises a hook or projection for seating said insert moulding onto an edge of the neck, wrist or ankle seal of the wetsuit.

18. The sports suit according to claim 1 wherein the tubes are configured such that they are removable from the sports suit.

19. The sports suit according to claim 18 wherein the sports suit is provided with one or more stoppers for fitting into the one or more entry or exit points after removal of the tubing.

20. A kit of parts configured and arranged to form the sports suit being a wetsuit or a dry suit for use in water sporting comprising a heating system according to claim 1, the kit of parts comprising: a mouth piece, one or more lengths of tubing, one or more entry mouldings defining a bore sized to closely receive the tubing, one or more exit mouldings defining a bore sized to closely receive the tubing, and one or more insert mouldings, wherein the mouth piece and one or more lengths of tubing are structured and configured such that upon assembly of the kit of parts tubing extends out of one or each side of the mouth piece; wherein the one or more entry mouldings or the one or more insert mouldings and the one or more lengths of tubing are structured and arranged such that upon assembly of the kit of parts, one or more water tight entry points are formed proximate to a neck opening of the sports suit; and wherein the one or more exit mouldings are configured and arranged such that upon assembly of the kit of parts one or more water tight exit points are disposed proximate at least one of a wrist opening and an ankle opening of the sports suit and tubing passes through said one or more water tight exit points and terminates proximate the at least one of the wrist opening and the ankle opening of the sports suit such that the heating system is configured to supply exhaled breath, input at the mouth piece, to at least one of a hand and a foot of a user of the sports suit assembled using the kit of parts.

21. The kit of parts according to claim 20 wherein the kit further comprises one or more stoppers for fitting into the one or more entry or exit mouldings.

22. The kit of parts according to claim 20 wherein the entry and exit mouldings comprise a tapered body having a bore therethrough and wherein one end of the bore is a circular aperture and wherein the other end of the bore is an elliptical aperture disposed within a base portion of the moulding that provides a perimeter about the body which is used to form a sealing bond with the sports suit.

23. The kit of parts according to claim 20 for a wetsuit wherein the insert moulding is configured for disposal at least substantially within an integral neck, wrist or ankle seal of a wetsuit and comprises a body having one or more bores therethrough for the tubing and a hook or projection for seating the insert moulding onto an edge of the neck, wrist or ankle seal of a wetsuit.

* * * * *